US011812798B2

(12) United States Patent
Blanton

(10) Patent No.: US 11,812,798 B2
(45) Date of Patent: Nov. 14, 2023

(54) JACKET SYSTEM WITH INTERCHANGEABLE ELEMENTS

(71) Applicant: Tamara Blanton, Riverdale, GA (US)

(72) Inventor: Tamara Blanton, Riverdale, GA (US)

( * ) Notice: Subject to any disclaimer, the term of this patent is extended or adjusted under 35 U.S.C. 154(b) by 0 days.

(21) Appl. No.: 16/910,991

(22) Filed: Jun. 24, 2020

(65) Prior Publication Data

US 2021/0401072 A1 Dec. 30, 2021

(51) Int. Cl.

*A41D 1/02* (2006.01)
*A41D 15/00* (2006.01)
*A41D 1/06* (2006.01)

(52) U.S. Cl.

CPC ..... *A41D 1/02* (2013.01); *A41D 1/06* (2013.01); *A41D 15/00* (2013.01); *A41D 15/002* (2013.01); *A41D 2200/20* (2013.01); *A41D 2300/33* (2013.01); *A41D 2400/70* (2013.01)

(58) Field of Classification Search

CPC ... A41D 1/02; A41D 1/06; A41D 3/02; A41D 3/04; A41D 3/06; A41D 15/00; A41D 15/002; A41D 2200/20; A41D 2300/33; A41D 2400/70; A41D 13/0012; A42B 1/206; A42B 1/048

USPC ..... 2/209.11, 269

See application file for complete search history.

(56) References Cited

U.S. PATENT DOCUMENTS 1,298,043 A * 3/1919 Hollander ..... A41D 15/00 2/70
1,611,420 A * 12/1926 Cuddy ..... A41D 15/00 2/79
2,020,155 A * 11/1935 Molter ..... A41F 1/00 2/82
2,087,763 A * 7/1937 Liebmann ..... A41D 1/00 2/70
2,152,575 A * 3/1939 Urbon ..... A41D 1/00 2/70
2,562,234 A * 7/1951 Gottschalk ..... A41B 1/06 2/117
2,970,316 A * 2/1961 Silin ..... A45F 3/042 224/264
4,261,059 A * 4/1981 Spitz ..... A41D 3/00 2/108

(Continued)

*Primary Examiner* — Katherine M Moran
*Assistant Examiner* — Haley A Smith
(74) *Attorney, Agent, or Firm* — Kilpatrick Townsend & Stockton LLP

(57) ABSTRACT

Embodiments herein are jacket systems with interchangeable elements that can form a jacket with configurable or swappable components. For instance, a customizable jacket that includes components of the jacket system includes a jacket body, a sleeve-receiver fastener, and a waist-receiver fastener. The jacket body is configured to fasten into a closed configuration and to unfasten into an open configuration. In the closed configuration, the jacket body defines an inner space interior to the jacket body. The sleeve-receiver fastener is integrated with the jacket body at a shoulder of the jacket body and is configured to attach a detachable sleeve, such that the detachable sleeve is toollessly detachable from the body. The waist-receiver fastener is integrated with the jacket body along a lower portion of the body, and the waist-receiver fastener is configured to attach a detachable waistband, such that the detachable waistband is toollessly detachable from the body.

3 Claims, 16 Drawing Sheets

(56) References Cited

U.S. PATENT DOCUMENTS 4,272,852 A * 6/1981 Bell ..... A41D 3/00 224/257
4,555,812 A * 12/1985 Akers ..... A41D 15/04 2/94
4,563,776 A * 1/1986 Boesen ..... A41D 3/02 2/85
4,766,613 A * 8/1988 Wells ..... A41D 15/002 2/227
5,182,812 A * 2/1993 Goldsby ..... A61H 36/00 2/227
5,774,892 A * 7/1998 Tisdale ..... A41D 1/06 2/115
5,909,802 A * 6/1999 Puco ..... A45F 3/04 224/148.1
6,047,404 A * 4/2000 Blanks, I ..... A41D 15/00 2/108
9,022,269 B1 * 5/2015 Woodcock ..... A45F 4/12 224/583
9,596,921 B1 3/2017 Blanton
10,136,721 B2 11/2018 Blanton
10,231,493 B1 * 3/2019 Sarantos ..... A41D 1/04
10,485,278 B2 * 11/2019 Noll ..... A41D 3/00
2005/0044605 A1 * 3/2005 Hofmann ..... A62B 17/001 2/69
2005/0050614 A1 * 3/2005 Leung ..... A41D 3/08 2/209.13
2005/0114979 A1 * 6/2005 Woolcott ..... A41D 3/00 2/69
2010/0199404 A1 * 8/2010 Garza ..... A41D 3/02 2/244
2015/0335076 A1 * 11/2015 Casarona ..... A41B 1/08 2/69
2017/0295913 A1 * 10/2017 Gaskin ..... A45F 4/02
2018/0064190 A1 * 3/2018 Khan ..... A41D 1/005
2019/0246712 A1 * 8/2019 Sonksen ..... A41D 15/04
2019/0246723 A1 * 8/2019 Reimer ..... A41D 1/02
2020/0107602 A1 * 4/2020 Domenighini ..... A42B 1/008

* cited by examiner

JACKET SYSTEM WITH INTERCHANGEABLE ELEMENTS

TECHNICAL FIELD

Embodiments of the present invention relate to clothing and, more particularly, to a jacket system with interchangeable elements, such that one or more elements are attachable together to form a configurable jacket.

BACKGROUND

A jacket is a type of garment used to cover the upper body and, typically, to cover a layer of clothing between the jacket and the upper body. Jackets can be used for added warmth or for fashion. As seasons change and thus the weather changes, a person may switch from wearing a particular jacket to a heavier jacket that is more appropriate for colder weather or to a lighter jacket that is more appropriate for warmer weather. Further, as fashion trends change or as a wearer's style preferences change, the wearer may invest in additional jackets in different styles or colors or featuring different symbols, logos, or images. Thus, a wearer may have multiple jackets.

Over time, a jacket is likely to experience wear, especially if the wearer wears or launders the jacket frequently. For instance, prolonged use can cause the colors and designs on exterior surfaces of the jacket to fade, and contact with other surfaces (e.g., the backs of chairs while the jacket is being worn) can cause the materials of the jacket to break down. When a jacket is too worn, the wearer typically stops using the jacket, even in circumstances where the wearer still likes the design of the jacket and would continue wearing the jacket were it in good condition.

Jackets tend to be limited not only in terms of lifespan, but also in term of style. Conventionally, jackets are designed by companies according to design strategies or cost strategies. For instance, a jacket manufacturer might take advantage of discounts on specific fabrics in specific colors are might have a partnerships with certain other organizations associated with certain logos or other symbols, or the jacket manufacturer may have performed market research that points to certain colors or patterns being on trend. Because of these circumstances, the manufacturer might manufacture jackets in specific styles, colors, or fabrics or with specific symbols. When a trend changes or if a wearer's preferences change, the wearer might no longer desire to wear the jacket. Further, because of expense limitations, it may not be financially feasible for a wearer to purchase jackets in line with all the styles, colors, or fabrics the wearer likes. For instance, a special edition jacket might be released in honor of an event or an individual, and the wearer might be unable or unwilling to invest in a jacket that could have appeal for a short period of time.

SUMMARY

In one embodiment, a customizable jacket that includes components of a jacket system includes a jacket body, a sleeve-receiver fastener, and a waist-receiver fastener. The jacket body is configured to fasten into a closed configuration and to unfasten into an open configuration. In the closed configuration, the jacket body defines an inner space interior to the jacket body. The sleeve-receiver fastener is integrated with the jacket body at a shoulder of the jacket body and is configured to attach a detachable sleeve, such that the detachable sleeve is toollessly detachable from the body.

The waist-receiver fastener is integrated with the jacket body along a lower portion of the body, and the waist-receiver fastener is configured to attach a detachable waistband, such that the detachable waistband is toollessly detachable from the body.

In another embodiment, a jacket system includes a jacket body and a detachable waistband. The jacket body is configured to fasten into a closed configuration and to unfasten into an open configuration. In the closed configuration, the jacket body defines an inner space interior to the jacket body. The jacket body includes a waist-receiver fastener that is integrated with the jacket body along a lower portion of the jacket body. The detachable waistband of the jacket system is toollessly attachable to the jacket body at the waist-receiver fastener, and the detachable waistband is further toollessly detachable from the jacket body.

In yet another embodiment, a jacket system includes a jacket body, a waistband, a trench bottom, a pant, one or more sleeves, one or more straps, and a hood. The jacket body is configured to fasten into a closed configuration and to unfasten into an open configuration. In the closed configuration, the jacket body defines an inner space interior to the jacket body. The jacket body includes a waist-receiver fastener disposed proximate a lower portion of the jacket body, one or more sleeve-receiver fasteners disposed proximate shoulders of the jacket body, and a strap-receiver fastener disposed proximate a shoulder of the jacket body. The waistband is attachable to the waist-receiver fastener of the jacket body and detachable from the waist-receiver fastener of the jacket body. The trench bottom is attachable to the waist-receiver fastener of the jacket body and detachable from the waist-receiver fastener of the jacket body. The pant is attachable to the waist-receiver fastener of the jacket body and detachable from the waist-receiver fastener of the jacket body. The waistband, the trench bottom, and the pant are configured for swappability with one another. One or more sleeves are attachable to the one or more sleeve-receiver fasteners of the jacket body and detachable from the one or more sleeve-receiver fasteners of the jacket body. One or more straps are attachable to the strap-receiver fastener of the jacket body and detachable from the strap-receiver fastener of the jacket body, and the one or more straps include a hood-receiver fastener. The hood is attachable to the hood-receiver fastener of the one or more straps to attach the hood to the jacket body, and the hood is detachable from the hood-receiver fastener of the one or more straps to detach the hood from the jacket body.

These illustrative aspects and features are mentioned not to limit or define the presently described subject matter, but to provide examples to aid understanding of the concepts described in this application. Other aspects, advantages, and features of the presently described subject matter will become apparent after review of the entire application.

BRIEF DESCRIPTION OF THE FIGURES

These and other features, aspects, and advantages of the present disclosure are better understood when the following Detailed Description is read with reference to the accompanying drawings.

DETAILED DESCRIPTION

As described above, there are various reasons for which a wearer might wish to acquire a new jacket. For instance, a wearer might get a new jacket due to a weather change, preference change, wearing out of an old jacket, or attraction to a new jacket. However, discarding a jacket that is still wearable can result in unnecessary waste, and purchasing a new jacket can be costly.

An embodiment of a jacket system described herein has configurable features and, specifically, has attachable and detachable elements, also referred to herein as components, capable of forming a customized and configurable jacket. Due to the configurability of the jacket, a component of the jacket may be swapped out and thus replaced without discarding the jacket as a whole. For instance, one or more of the following, as well as others, may be attachable to and detachable from a jacket body that acts as a base for the jacket: one or more sleeves, a waistband, a longline bottom, a pant, straps, a hood, an interior lining, and an exterior lining. The jacket may thus provide continued usefulness after repairing or replacing a damaged attachable element, or the jacket may enable a wearer to swap attachable elements to feature varying colors, styles, fabrics, or other useful or aesthetic elements. The interchangeability of attachable elements may reduce cost expenditures of the wearer, may extend the life of the jacket, and may reduce waste by reducing or eliminating the need to discard the jacket as a whole when only a portion of the jacket presents a problem (e.g., excessive wear).

It will be understood that, in this disclosure, the term "jacket" is used generally to refer to an outer-garment worn over other clothing on the upper body. A jacket described herein may be of various types, such as a blazer, a suit jacket, a coat, or a parka, and thus, the term "jacket" does not limit the style, length, or thickness of the garment.

Figure 1:
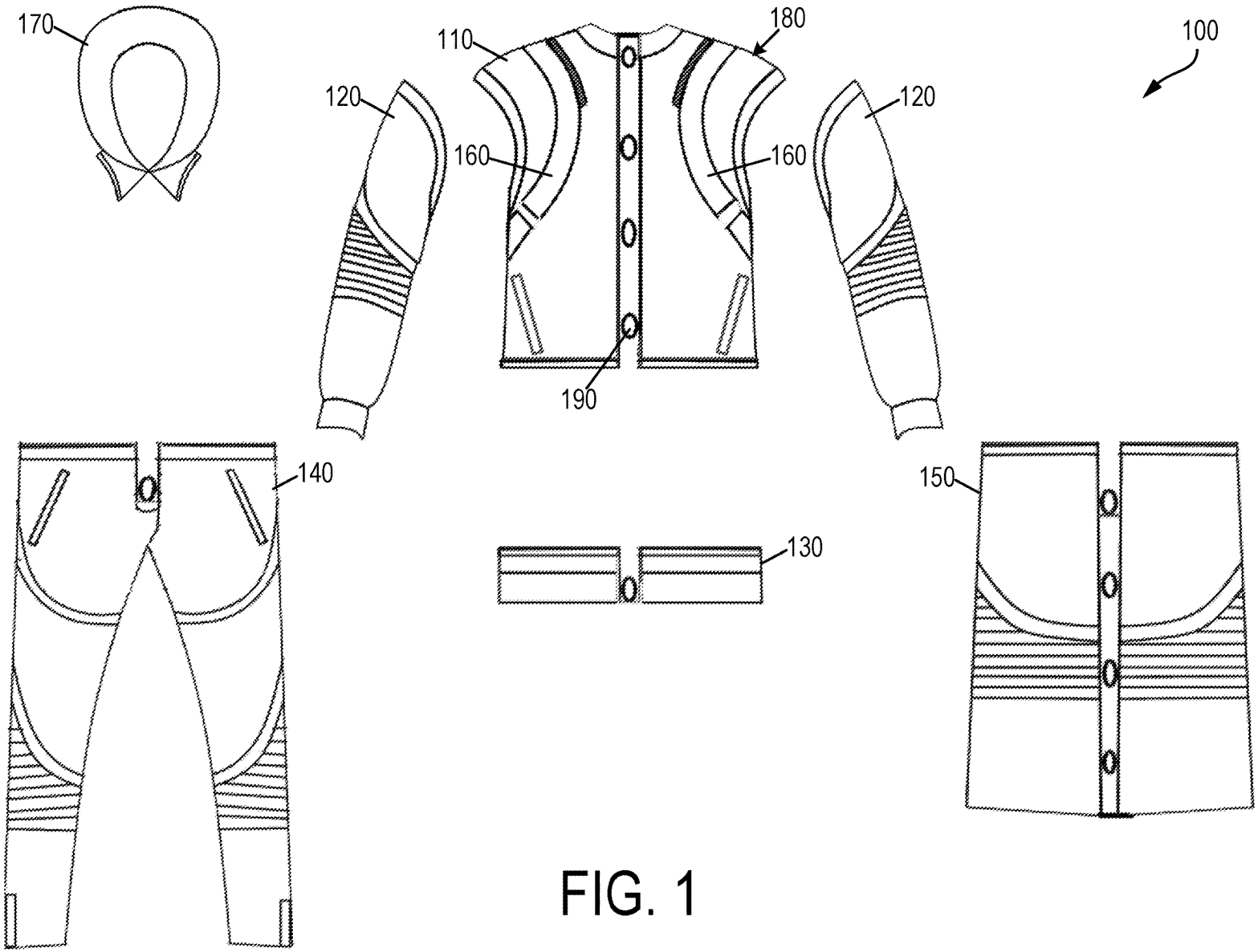
FIG. 1 shows a front view of various components of a jacket system, according to some embodiments described herein.

FIG. 1 shows a front view of various components of a jacket system 100, according to some embodiments described herein. As shown in FIG. 1, the jacket system 100 may include various attachable and optionally interchangeable components, or elements. For instance, the jacket system 100 includes a jacket body 110 among such components. The jacket body 110 may be attachable to one or more other components, such as the following, for example: sleeves 120, a waistband 130, a pant 140, a longline bottom 150, straps 160, and a hood 170. At a given time, a jacket 180 of the jacket system 100 includes the jacket body 110 and other components (e.g., sleeves 120, waistband 130, pant 140, longline bottom 150, straps 160, or hood 170), if any, attached to the jacket body 110.

In some embodiments, the jacket body 110 is a wearable garment configured to be wrapped around at least a portion of a wearer's upper body. The jacket body 110 may include two armholes, enabling the wearer to insert the wearer's arms so that the jacket body 110 is supported by the wearer's shoulders. The jacket body 110 can be closed or open at a given time. In some embodiments, when the jacket body 110 is closed on a wearer, an inner surface of the jacket body 110 sits against the wearer, who is positioned in an inner space defined by the jacket body 110.

As described in more detail below, to attach other components to the jacket body 110, the jacket body 110 may include one or more fasteners configured to removably attach components to the jacket body 110 to provide configurability, or customization, of the jacket 180 as a whole. For instance, the jacket body 110 may include one or more sleeve-receiver fasteners (e.g., two sleeve-receiver fasteners including one per sleeve 120) for attaching the sleeves 120; a waist-receiver fastener to attach the waistband 130, the pant 140, or the longline bottom 150; and a hood-receiver fastener to attach the hood 170. Analogously, the sleeves 120, the waistband 130, the pant 140, the longline bottom 150, and the hood 170 may include complementary fasteners to enable their respective attachments to the jacket body 110. The fasteners of the jacket system 100, including those on the jacket body 110, the sleeves 120, the waistband 130, the pant 140, the longline bottom 150, and the hood 170, may be of various types. For example, such fasteners may include one or more of the following: zippers, snap fasteners, buttons, clasps, clips, fabric tape, adhesive, and hook and loop fasteners such as Velcro®. Generally, in some embodiments, the fasteners described herein enable toolless (e.g., without the need for tools other than those included in the jacket system), manual connection and disconnection of components to and from the jacket body 110 or with one another.

In some embodiments, a pair of fasteners are complementary and enable two components to be removably attached. For instance, such a pair may be a sleeve-receive fastener of the jacket body 110 and a sleeve fastener of a sleeve 120, such that the sleeve-receiver fastener and the sleeve fastener engage with each other to secure the sleeve 120 to the jacket body 110. Other such pairs of complementary fasteners may include, for instance, the waist-receiver fastener of the jacket body 110 and a waistband fastener of the waistband, the waist-receiver fastener of the jacket body 110 and a pant fastener of the pant 140, the waist-receiver fastener of the jacket body 110 and a longline-bottom fastener of the longline bottom 150, and a hood-receiver fastener of the jacket body 110 and a hood fastener of the hood 170. It will be understood that the fasteners in such pairs, each including at least a first fastener of one component (e.g., the sleeve-receiver fastener of the jacket body 110) and a second fastener of another component (e.g., the sleeve fastener of a sleeve 120), may be made capable of engaging each other in various ways. In one example, when the first fastener and the second fastener form a zipper, the first fastener may include a retainer box and slider of the zipper, and the second fastener may include an insertion pin for insertion into the retainer box to enable a user to zip the zipper by sliding the slider along the two zipper halves to lock together the zipper teeth of the zipper halves. In some embodiments, to provide aesthetic appeal, the resulting zipper formed by the first fastener and the second fastener may be a hidden zipper, such as an invisible zipper or a lapped zipper having a concealing member (e.g., a portion of fabric) overlapping the zipper to conceal the zipper. In another example, the first fastener and the second fastener together form a snap fastener; in that case, the first fastener may include a groove enabled to receive and secure a portion of the second fastener. It will be understood that many implementations of the various fasteners described herein are possible and with the scope of this disclosure.

As shown in FIG. 1, the jacket body 110 may further include a body-closing fastener 190 useable to close the jacket body 110, such as vertically up or near the center of the jacket body 110 on a wearer's front. For instance, the body-closing fastener 190 may be a zipper extending from the front of the jacket body 110, at or near the horizontal center of the jacket body 110, upward to the top of the jacket body 110. In such an example, when the zipper is zipped, the jacket body 110 and thus the jacket 180 as a whole may be considered closed or zipped, and when the zipper is unzipped, the jacket body 110 and thus the jacket 180 as a whole may be considered open or unzipped. Additionally or alternatively, the body-closing fastener 190 may be a set of buttons or snap fasteners positioned approximately vertically along the jacket body 110, or the body-closing fastener 190 may be one or more clasps, clips, fabric tape, adhesive, or hook and loop fasteners.

In an embodiment, the jacket body 110 may be made of one or more of various fabrics, such as, for example, polyester, nylon rip stop fabric, cotton, polyurethane, or leather. Similarly, the sleeves 120, the waistband 130, the pant 140, the longline bottom 150, the hood 170, or other components of the jacket system 100 may be made of one or more of such fabrics used to make the jacket body 110 or, additionally or alternatively, one or more other fabrics. It will be understood that a wide range of fabrics are useable and that the choice of which fabrics to use to make the jacket body 110 and its attachable components may depend on current trends, the expected use of the jacket 180 or of the various attachable components, or other factors.

Various benefits arise through the ability to attach and detach various components to the jacket body 110 to form a customizable jacket 180. For instance, a wearer might desire to replace the sleeves 120 for various reasons, such as the elbows of the sleeves 120 becoming too worn, a tear or stain occurring on a sleeve 120, or a desire to replace with sleeves 120 with new sleeves 120 with a different design. The user can then acquire, such as through a new purchase, a new set of sleeves 120 without having to acquire an entire new jacket system 100 and without having to acquire a new jacket body 110. The user can then use the applicable fasteners of the sleeves 120 and the jacket body 110 to attach the new set of sleeves 120 to the jacket body 110 in place of the sleeves 120. Analogously, each of the waistband 130, pant 140, longline bottom 150, straps 160, and hood 170 may be replaced as well, and even the jacket body 110 can be replaced in some embodiments.

In some embodiments, a further benefit exists with respect to temporary unavailability of a portion of the jacket system 100. For instance, if a sleeve 120 or another attachable component requires repair or cleaning, that sleeve 120 or other component can be detached from the jacket body 110 and, in some instances, temporarily replaced with an alternative sleeve 120 or other component. If no replacement is used, then the jacket 180 remains useable even without the sleeve 120 or other attachable component. For instance, if the sleeves 120 are removed either temporarily or permanently, then the jacket 180 becomes useable as a sleeveless jacket, such as a vest. If the waistband 130 is removed either temporarily or permanently, then the jacket 180 becomes a cropped jacket or the waistband 130 can be replaced with the pant 140, the longline bottom 150, or an alternative waistband 130. It will be understood that various options exist for customizing or using the jacket 180 without one or more attachable components.

Figure 2:
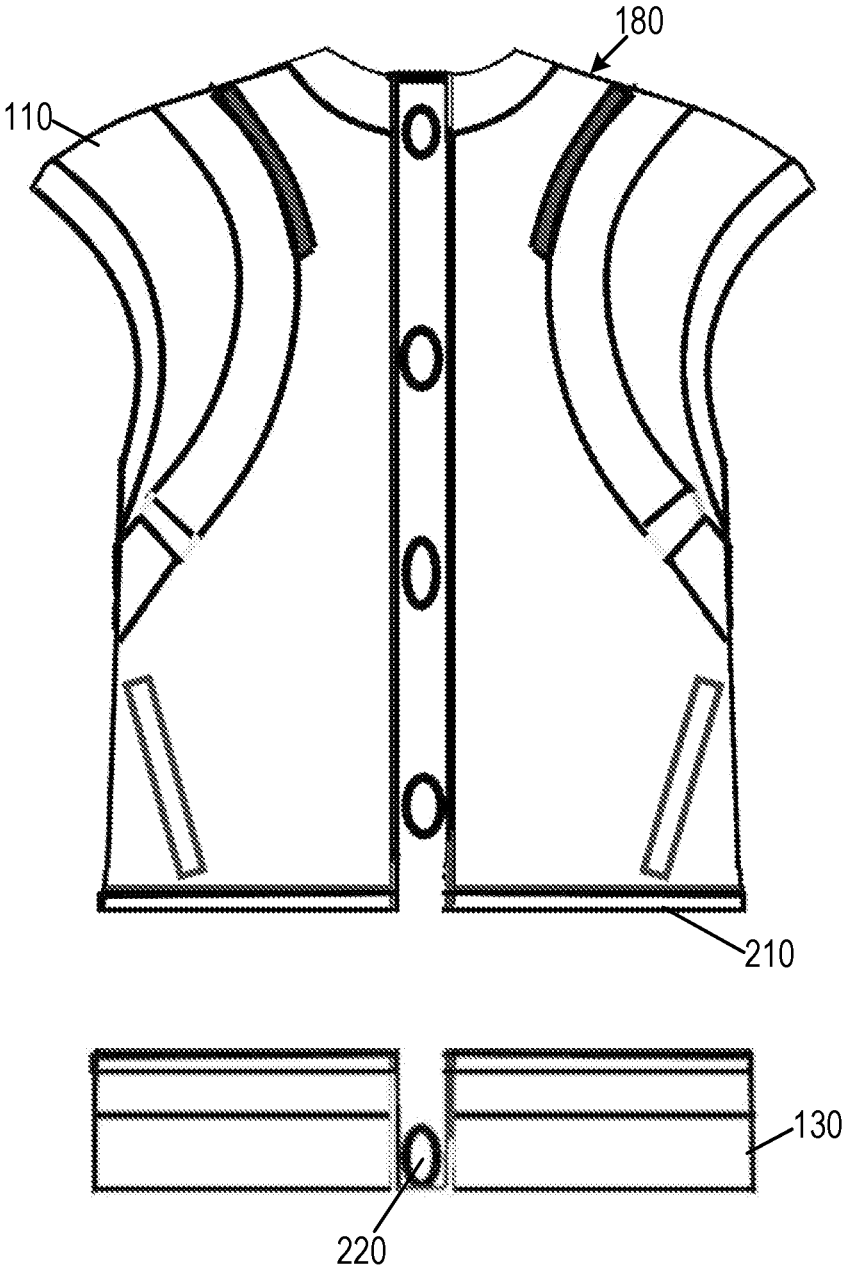
FIG. 2 shows an example of the jacket system including the jacket body and a waistband, according to some embodiments described herein.

FIG. 2 shows an example of the jacket system 100, or a portion of the jacket system 100, including the jacket body 110 and a waistband 130, according to some embodiments. In the example of FIG. 2, the waistband 130 is currently not attached to the jacket body 110. Thus, in the example shown, the jacket 180 in this example includes only the jacket body 110 because the jacket 180 includes the jacket body 110 along with the other components that are presently attached to the jacket body 110.

In some embodiments, when attached to the jacket body 110 and thus incorporated into the jacket 180, the waistband 130 is a bottom portion of the jacket 180 that wraps around the body at or near the waist or hip area. The waistband 130 may provide an aesthetic bottom to the jacket 180, such that the jacket 180 may appear unfinished or may simply have a different look, such as a cropped look, without the use of the waistband 130 or other component attached to the bottom of jacket body 110. For instance, the waistband 130 may include elastic that enables the bottom of the jacket 180 to fit more closely to the waist for aesthetic appeal. It will be understood, however, that the waistband 130 may take various styles.

An embodiment of the jacket body 110 includes a waist-receiver fastener 210 configured to engage with the waistband 130 so as to attach the waistband 130 to the jacket body 110. Specifically, an embodiment of the waist-receiver fastener 210 is positioned at a lower portion of the jacket body 110 so as to attach the waistband 130 at the bottom of the jacket body 110. The waist-receiver fastener 210 may be implemented as various types of devices, such as one or more clips, buttons, pins, or zippers. In some embodiments, the waist-receiver fastener 210 is integrated into the jacket body 110, such as by being sewn into the jacket body 110, at or near a lower portion or waist portion of the jacket body 110. For instance, the waist-receiver fastener 210 may be a zipper positioned along a bottom edge, or close to a bottom edge, of the jacket body 110 and extending along the length of the jacket body 110 when the jacket body 110 is open.

The waist-receiver fastener 210 may be configured to attach a component to the jacket body 110 to act as a bottom portion of the jacket 180. Such component may be, for instance, the waistband 130, the pant 140, or the longline bottom 150. In some embodiments, only one of the waistband 130, the pant 140, and the longline bottom 150 is attachable to the jacket body 110 at a given time, and the waistband 130, the pant 140, and the longline bottom 150 are interchangeable, such that one may be swapped for another by detaching the one and then attaching the other. More generally, when the jacket system 100 includes multiple components attachable to the waist-receiver fastener 210, such multiple components may be interchangeable, or swappable.

To enable fastening between the jacket body 110 and the waistband 130, the waistband 130 may include a waist fastener (not shown) configured to engage with the jacket body 110, specifically, for instance, with the waist-receiver fastener 210 of the jacket body 110. In some embodiments, the waist fastener may be integrated into the waistband 130, such as by being sewn into the waistband 130. Specifically, the waist fastener may be positioned near a top edge of the waistband 130. If the waist fastener is half of a zipper, for example, such zipper may extend around a circumference of the edge of the waistband 130.

Figure 3:
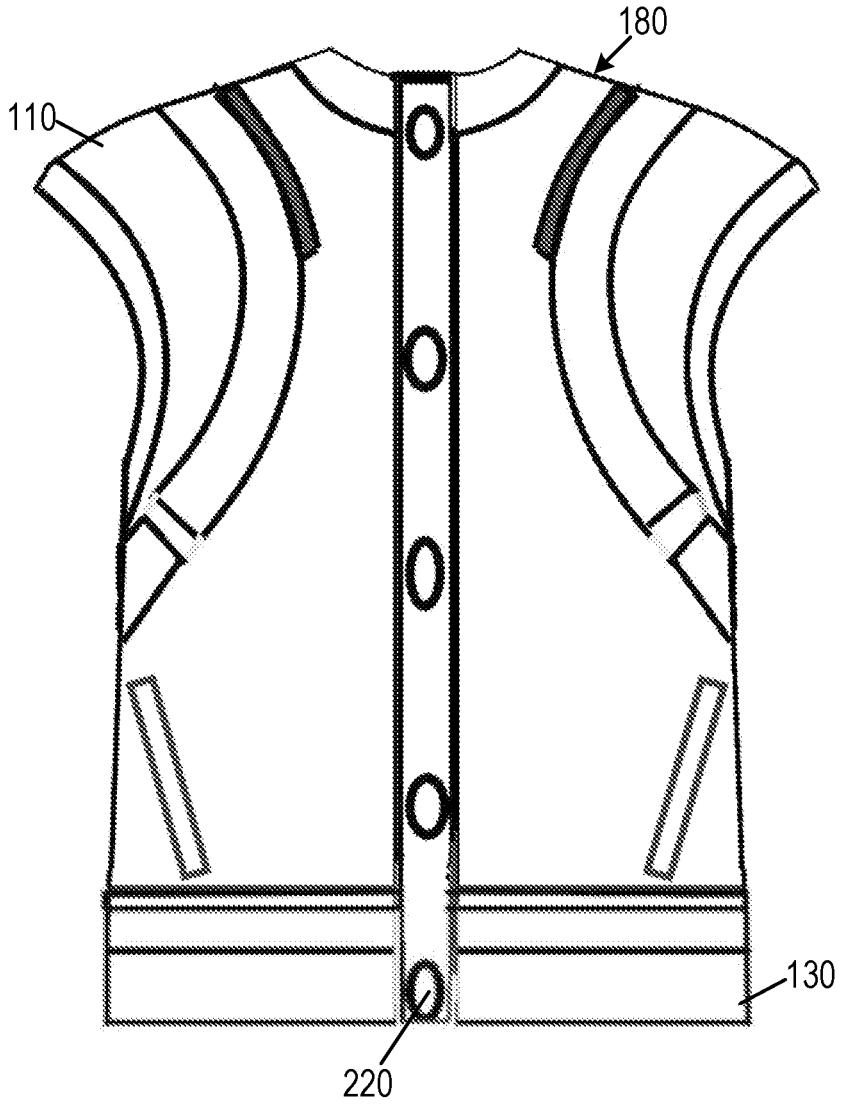
FIG. 3 shows the jacket system of FIG. 2 with the components configured to form a jacket that includes the jacket body and the waistband, according to some embodiments described herein.

FIG. 3 shows the jacket system 100 of FIG. 2 with the components configured to form a jacket 180 that includes the jacket body 110 and the waistband 130, according to some embodiments described herein As shown in this example, when the waistband 130 is fastened to the jacket body 110, as described above, a jacket 180 is formed that includes that jacket body 110 and the waistband 130. When such fastening is disengaged, the waistband 130 becomes detached once again. Thus, the waistband 130 is removably attachable to enable the waistband 130 to be attached to, and detached from, the jacket body 110 manually.

As is also shown in FIG. 2 and FIG. 3, the waistband includes its own waistband-closing fastener 220 configured to enable closing of the waistband 130, such as to secure the waistband 130 around or near a person's waist. When the waistband 130 is attached to the jacket body 110 and is therefore part of the jacket 180, the waistband-closing fastener 220 of the waistband 130 may be positioned so as to provide a continuous opening with an opening of the jacket body 110 such that, when the jacket body 110 and the waistband 130 are both open, the jacket 180 as a whole is open.

Figure 4:
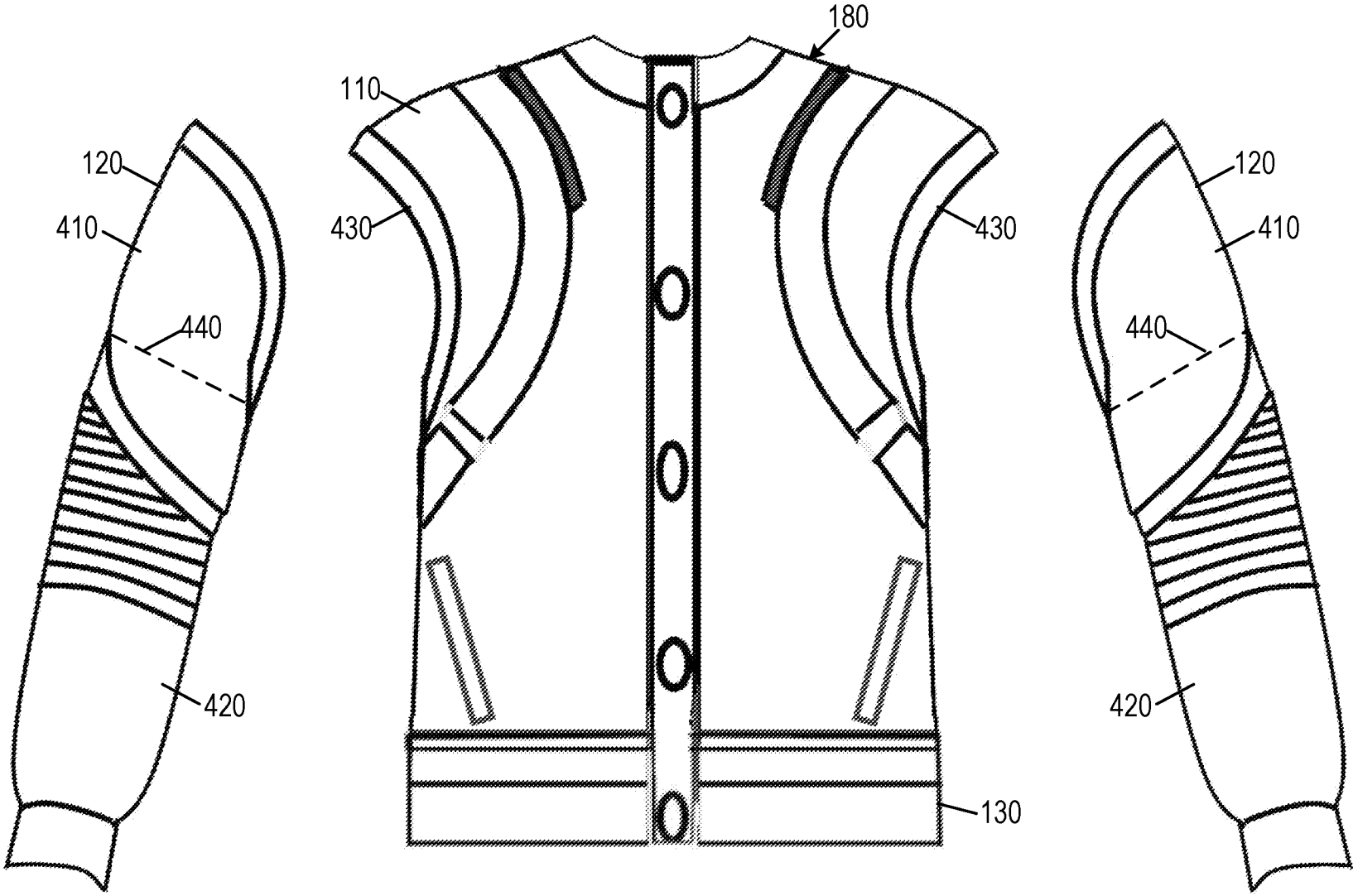
FIG. 4 shows an example of the jacket system including a jacket body and two sleeves, according to some embodiments described herein.

FIG. 4 shows an example of the jacket system 100, or a portion of the jacket system 100, including the jacket body 110 and two sleeves 120, according to some embodiments. In the example shown, the jacket system 100 additionally includes the waistband 130, which is attached to the jacket body 110. This example of the jacket system 100 may, but need not, include other components not shown in FIG. 4. In this example, the jacket system 100 includes two sleeves 120; additionally or alternatively, however, the jacket system 100 may include only one sleeve. In the example of FIG. 4, the sleeves 120 are currently not attached to the jacket body 110, but the waistband 130 is attached to the jacket body 110. Thus, in the example shown, the jacket 180 includes the jacket body 110 and the waistband 130, but not the sleeves 120, because the jacket 180 includes the jacket body 110 along with the attachable components that are presently attached to the jacket body 110.

Some embodiments of the jacket body 110 include a set of sleeve-receiver fasteners 430 configured to engage with one or more sleeves 120, specifically to one or more sleeve fasteners of the sleeves 120, so as to attach the one or more sleeves 120 to the jacket body 110. The set of sleeve-receiver fasteners 430 may include one or more sleeve-receiver fasteners 430 such that the set is configured to attach one or more sleeves 120. Specifically, in some embodiments, the jacket body 110 includes sleeve-receiver fasteners 430 configured to attach two sleeves 120 at a given time, such that a user can insert an arm into each sleeve 120. For instance, the jacket body 110 includes two sleeve-receiver fasteners 430 including one respective sleeve-receiver fastener 430 for each sleeve 120. However, it will be understood that alternative configurations are possible; for instance, a single sleeve-receiver fastener 430 that extends across the width of the jacket body 110 may be used to attach a single garment that includes both sleeves 120. The sleeve-receiver fastener 430 may be implemented as various types of devices, such as one or more clips, buttons, pins, or zippers. In some embodiments, the sleeve-receiver fastener 430 is integrated into the jacket body 110, such as by being sewn into the jacket body 110 at or near a shoulder of the jacket body 110.

To enable fastening between the jacket body 110 and the sleeves 120, each sleeve 120 may include a sleeve fastener configured to engage with the jacket body 110, specifically, for instance, with a sleeve-receiver fastener 430 of the jacket body 110, to removably attach and thereby at least temporarily secure the sleeve 120 to the jacket body 110. In some embodiments, the sleeve fastener may be integrated into the sleeve 120, such as by being sewn into the sleeve 120. Specifically, the sleeve fastener may be positioned near a shoulder portion at the end of the sleeve 120 that attaches to the jacket body 110. If the sleeve fastener is a portion of a zipper, for example, such zipper may extend around a circumference of the sleeve 120 at or near and edge of the sleeve 120.

In some embodiments, a sleeve 120 is configured to be shortened. For instance, the sleeve 120 may include a sleeve top 410 and a sleeve extension 420, where a central sleeve fastener 440 is configured to attach the sleeve top 410 to the sleeve extension 420. The sleeve top 410 may be attachable directly to the jacket body 110, and the sleeve extension 420 may be useable to extend the length of the sleeve 120 when attached to the sleeve top 410. For instance, when the sleeve top 410 is attached to the jacket body 110 and the sleeve extension 420 is attached to the sleeve top 410, the sleeve 120 may extend to the wrist of the wearer. However, when the sleeve extension 420 is not attached, the sleeve 120 may extend only to the bicep or to the elbow. Thus, removing the sleeve extension 420 may shorten the length of the sleeve 120; in this manner, the sleeve 120 may become a short sleeve. When the central sleeve fastener 440 is fastened to the sleeve extension 420, however, the sleeve 120 may be a long sleeve or a three-quarter sleeve. However, it will be understood that there is no requirement that a sleeve extension 420 and the central sleeve fastener 440 be used, and rather, the sleeve 120 may be a single length that may be long, short, or otherwise.

Figure 5:
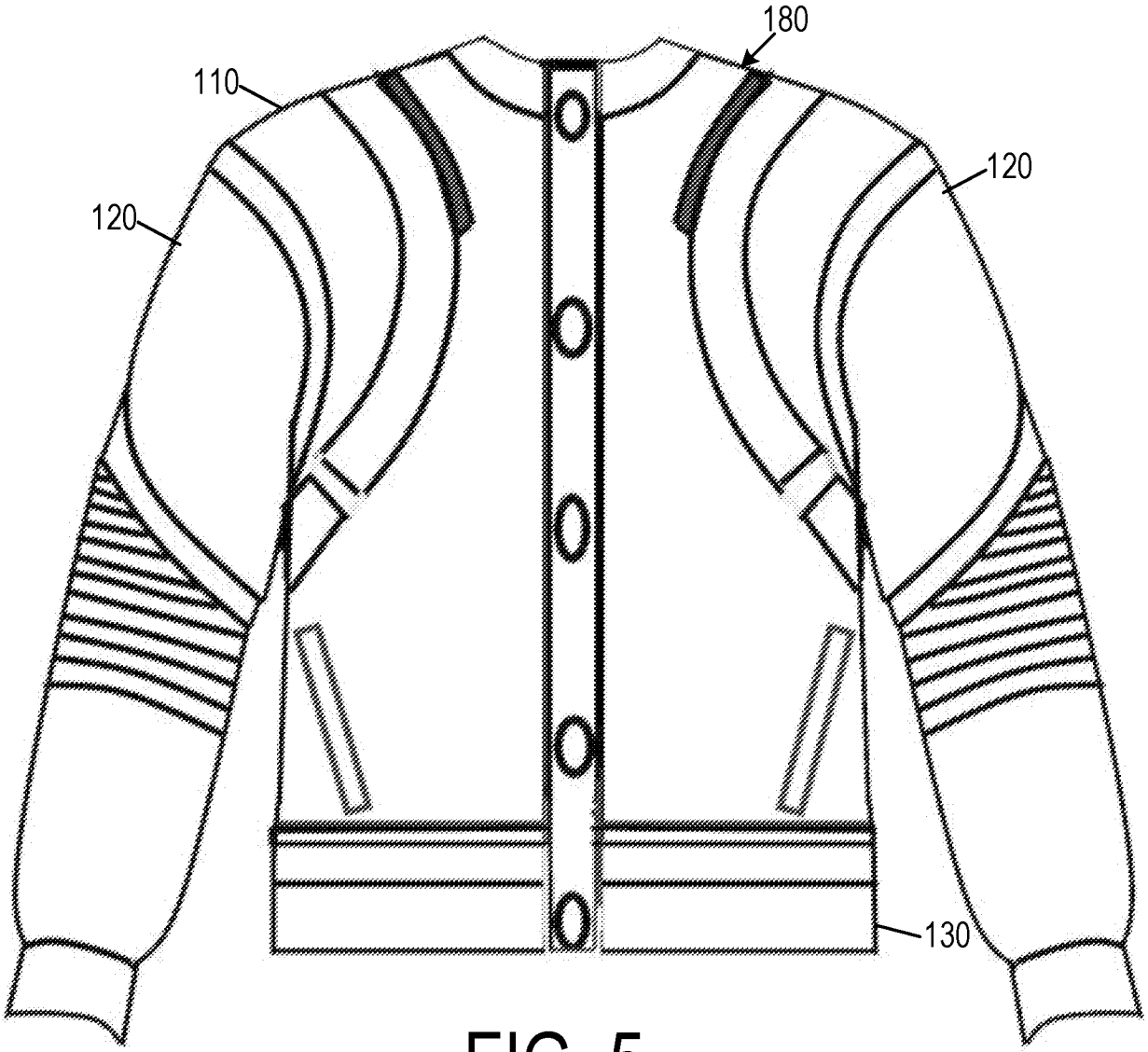
FIG. 5 shows the jacket system of FIG. 4 with the components configured to form a jacket that includes the jacket body and the sleeves, according to some embodiments described herein.

FIG. 5 shows the jacket system 100 of FIG. 4 with the components configured to form a jacket 180 that includes the jacket body 110 and the sleeves 120, according to some embodiments. In this example, the resulting jacket 180 also includes the waistband 130 attached to the jacket body 110.

As shown in this example, when the sleeves 120 are fastened to the jacket body 110, such as through the use of fasteners as described above, a jacket 180 is formed that includes that jacket body 110, the waistband 130, and the two sleeves 120. When such fasteners are disengaged, the sleeves 120 then become detached once again. Thus, the sleeves 120 are removably attachable to enable the sleeves 120 to be attached to, and detached from, the jacket body 110 manually.

An example of a sleeve 120 may be in the style of a motorcycle jacket. Specifically, as shown in FIGS. 4 and 5, the elbows of the sleeves 120 may include a leather or leather-like material that is ribbed in the style of motorcycle jackets. The leather or leather-like material may provide a degree of protection in the case of contact with a road. However, it will be understood that this style of sleeve 120 is for illustrative purposes and that various other styles and materials are within the scope of this disclosure.

Figure 6:
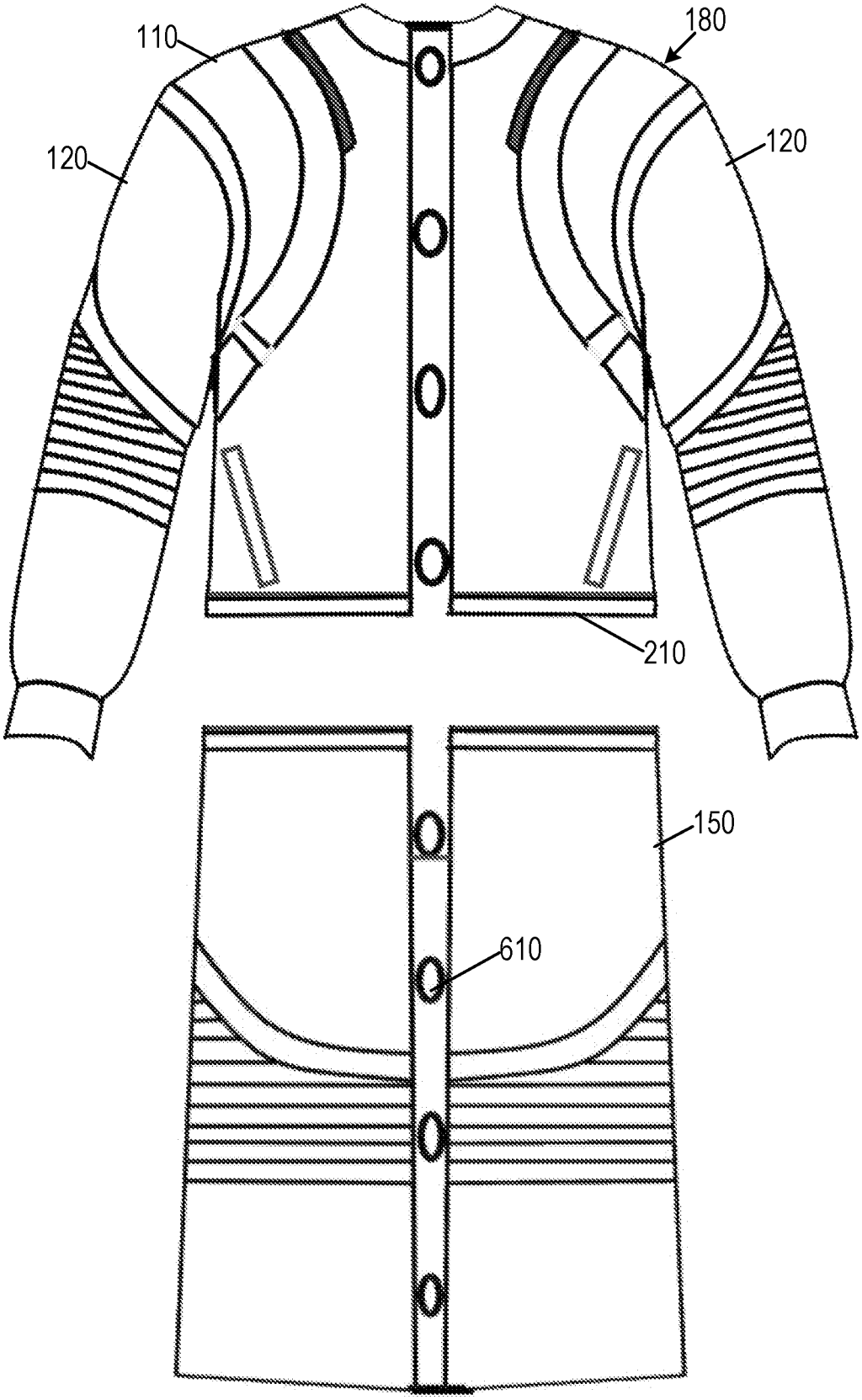
FIG. 6 shows an example of the jacket system including the jacket body and a longline bottom, according to some embodiments described herein.

FIG. 6 shows an example of the jacket system 100 including the jacket body 110 and a longline bottom 150, according to some embodiments described herein. In the example of FIG. 6, the longline bottom 150 is currently not attached to the jacket body 110, but a pair of sleeves 120 is attached. Thus, in the example shown, the jacket 180 includes the jacket body 110 and the sleeves 120, but not the longline bottom 150, because the jacket 180 includes the jacket body 110 along with the attachable components that are presently attached to the jacket body 110.

In some embodiments, when attached to the jacket body 110 and thus incorporated into the jacket 180, the longline bottom 150 is a bottom portion of the jacket 180 that causes the jacket 180 to be longer than the jacket 180 would be with the waistband 130 attached. Thus, the longline bottom 150 may be longer than the waistband 130 and therefore elongates the jacket 180. For instance, the longline bottom 150 may be calf length, knee length, or ankle length. The longline bottom 150 may cause the jacket 180 to become a trench coat or other long coat style. Thus, in some cases, the longline bottom 150 may provide additional protection from cold or wet weather as compared to the waistband 130 or may simply provide a different aesthetic.

To enable fastening between the jacket body 110 and the longline bottom 150, the longline bottom 150 may include a waist fastener (not shown) configured to engage with the jacket body 110, specifically, for instance, with the waist-receiver fastener 210 of the jacket body 110. In some embodiments, the waist fastener may be integrated into the longline bottom 150, such as by being sewn into the longline bottom 150. Specifically, the waist fastener may be positioned near a top edge of the longline bottom 150. If the waist fastener is a portion of a zipper, for example, such zipper may extend along an edge of the longline bottom 150 where the longline bottom 150 is configured to attach to the jacket body 110.

Figure 7:
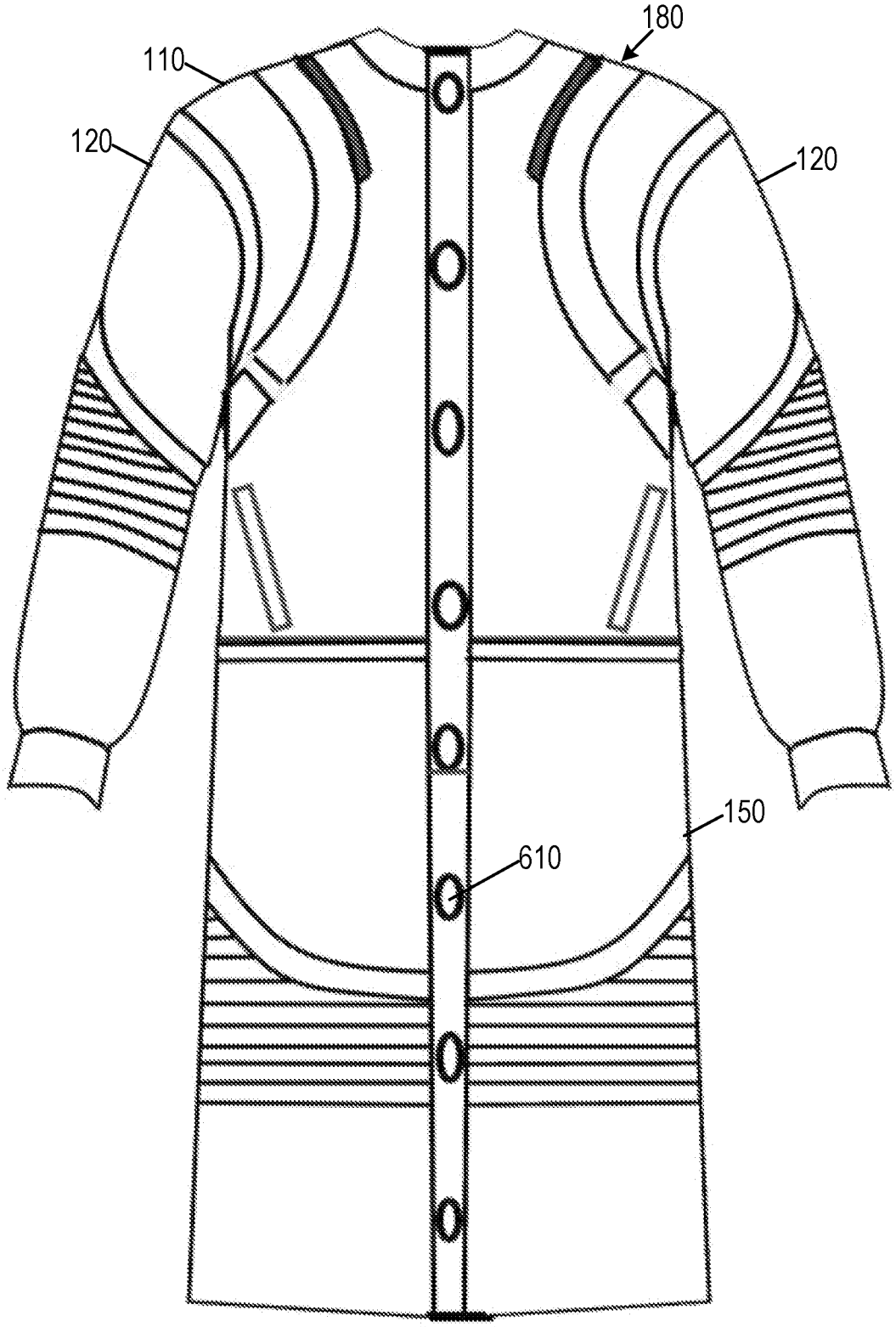
FIG. 7 shows the jacket system of FIG. 6 with the components configured to form a jacket that includes the jacket body and the longline bottom, according to some embodiments described herein.

FIG. 7 shows the jacket system 100 of FIG. 6 with the components configured to form a jacket 180 that includes the jacket body 110 and the longline bottom 150, according to some embodiments described herein. In this example, the resulting jacket 180 also includes two sleeves 120 attached to the jacket body 110. As shown in this example, when the longline bottom 150 is fastened to the jacket body, a jacket 180 is formed that includes that jacket body 110 and the longline bottom 150. When such fasteners are disengaged, the longline bottom 150 then becomes detached once again. Thus, the longline bottom 150 is removably attachable to enable the longline bottom 150 to be attached to, and detached from, the jacket body 110 manually.

As is also shown in FIG. 6 and FIG. 7, an embodiment of the longline bottom includes its own bottom-closing fastener 610 configured to enable closing of the longline bottom 150, such as to secure the longline bottom 150 around a person. When the longline bottom 150 is attached to the jacket body 110 and is therefore part of the jacket 180, the bottom-closing fastener 610 of the longline bottom 150 may be positioned so as to provide a continuous opening with an opening of the jacket body 110 such that, when the jacket body 110 and the longline bottom 150 are both open, the jacket 180 as a whole is open.

Figure 8:
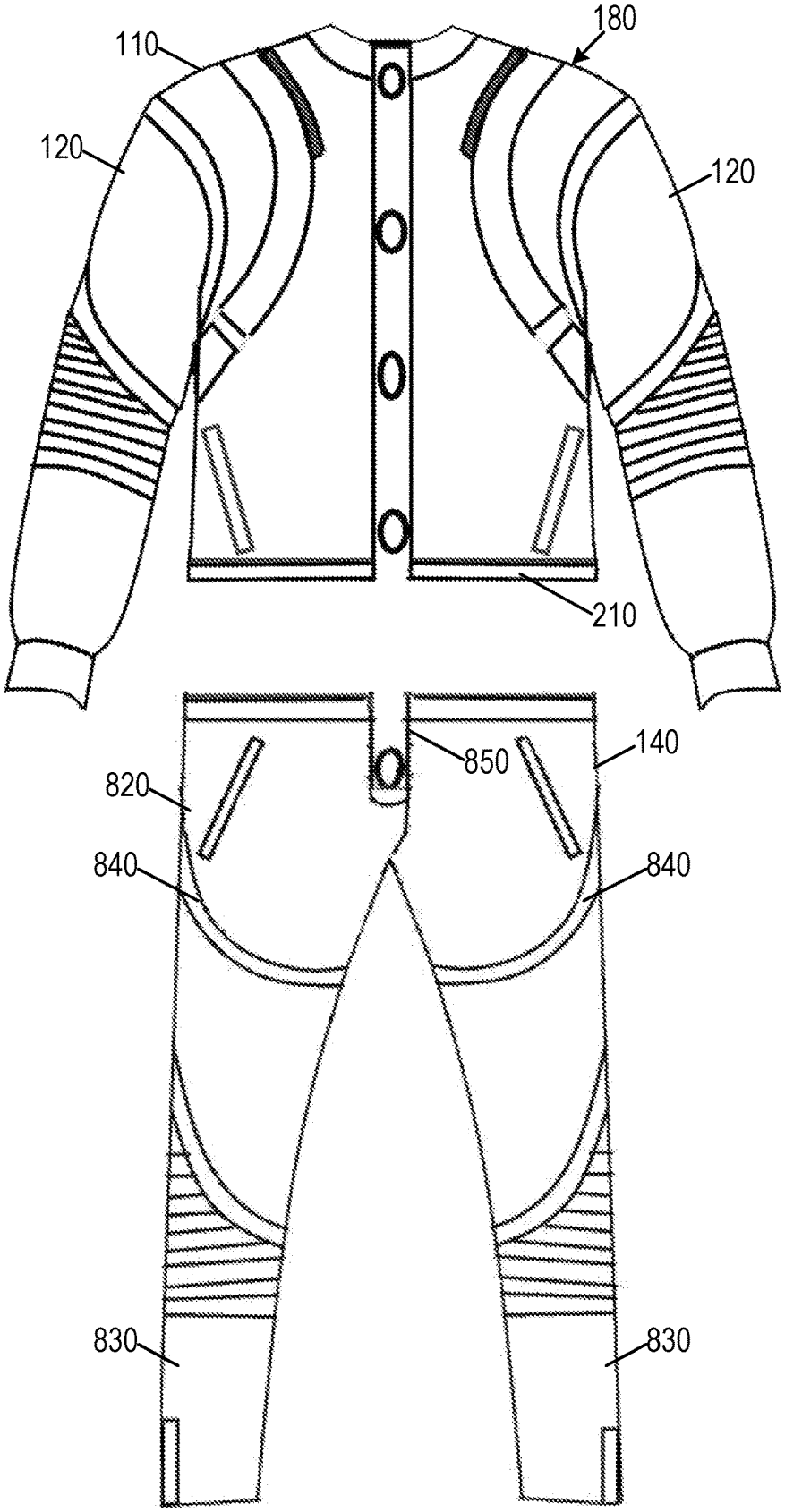
FIG. 8 shows an example of the jacket system including the jacket body and a pant, according to some embodiments described herein.

FIG. 8 shows an example of the jacket system 100 including the jacket body 110 and a pant 140, according to some embodiments described herein. In the example of FIG. 8, the pant 140 is currently not attached to the jacket body 110, but a pair of sleeves 120 is attached. Thus, in the example shown, the jacket 180 includes the jacket body 110 and the sleeves 120, but not the pant 140, because the jacket 180 includes the jacket body 110 along with the attachable components that are presently attached to the jacket body 110.

In some embodiments, when attached to the jacket body 110 and thus incorporated into the jacket 180, the pant 140 is a bottom portion of the jacket 180 that causes the jacket 180 to be longer than the jacket 180 would be with the waistband 130 attached. Thus, the pant 140 may be longer than the waistband 130. For instance, the pant 140 may be calf length, knee length, or ankle length. Further, the pant 140 may include a respective opening for each leg. The pant 140 may cause the jacket 180 to become a jumpsuit or other garment that combines a jacket and a pant. Thus, in some cases, the pant 140 may provide additional protection from cold or wet weather as compared to the waistband 130 or may simply provide a different aesthetic.

To enable fastening between the jacket body 110 and the pant 140, the pant 140 may include a pant-waist fastener (not shown) configured to engage with the jacket body 110, specifically, for instance, with the waist-receiver fastener 210 of the jacket body 110. In some embodiments, the waist fastener may be integrated into the pant 140, such as by being sewn into the pant 140. Specifically, the waist fastener may be positioned near a top edge of the pant 140. If the waist fastener is a half of a zipper, for example, such zipper may extend around a circumference at or near a top edge of the pant 140.

Figure 11:
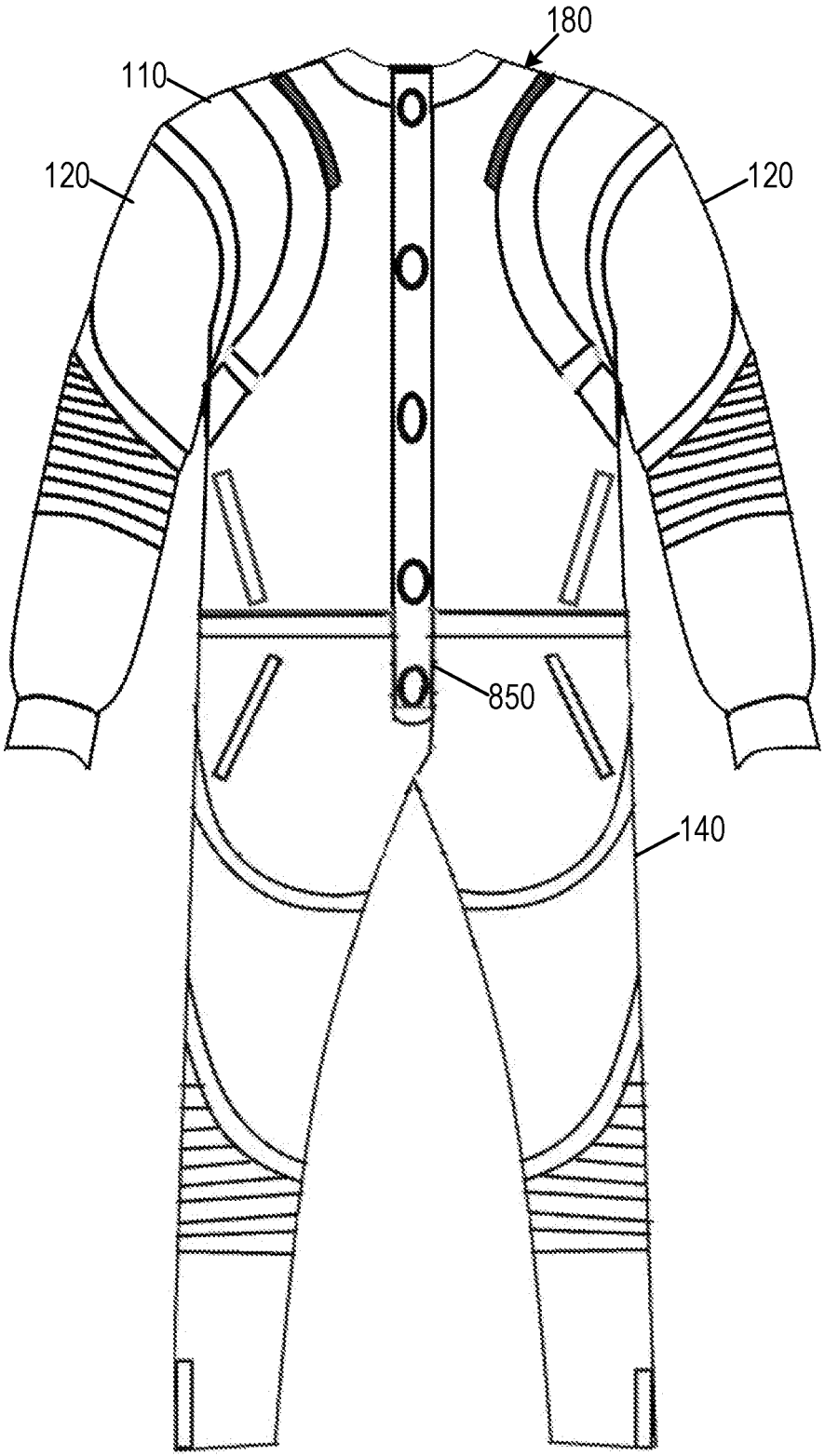
FIG. 11 shows the jacket system of FIG. 8 with the components configured to form a jacket that includes the jacket body and the pant, according to some embodiments described herein.

The pant 140 may include two pant legs. An example of a pant leg may be in the style of a motorcycle jacket. Specifically, as shown in FIGS. 8 and 11, the knees of the pant legs may include a leather or leather-like material that is ribbed in the style of motorcycle jackets. The leather or leather-like material may provide a degree of protection in the case of contact with a road. However, it will be understood that this style of pant leg is for illustrative purposes and that various other styles and materials are within the scope of this disclosure.

In some embodiments, the pant 140 is configured to be shortened or, in other words, to have a shortened variation. For instance, the pant 140 may include a pant top 820 and one or more leg extensions 830 (e.g., one for each leg), where a respective leg fastener 840 is configured to attach each leg extension 830 to the pant top 820. The pant top 820 may be attachable directly to the jacket body 110 at the waist-receiver fastener 210 of the jacket body 110, and each leg extension 830 may be useable to extend the length of a leg of the pant 140 when attached to the pant top 820. When a leg fastener 840 is unfastened, the respective leg extension 830 may be detached from the pant top 820, thus shortening the length of that leg of the pant 140. When both leg extensions 830 are unattached from the pant top, the pant 140 may become a short pant, or shorts. When the leg fasteners 840 are fastened to respective leg extensions 830, however, the pant 140 may be a long pant, a three-quarter pant, or some other pant that is longer than the pant 140 is when no leg extensions 830 are attached. However, it will be understood that there is no requirement that leg extensions 830 and leg fasteners 840 be used, and rather, the pant 140 may be a single length that may be long, short, or otherwise.

Figure 9:
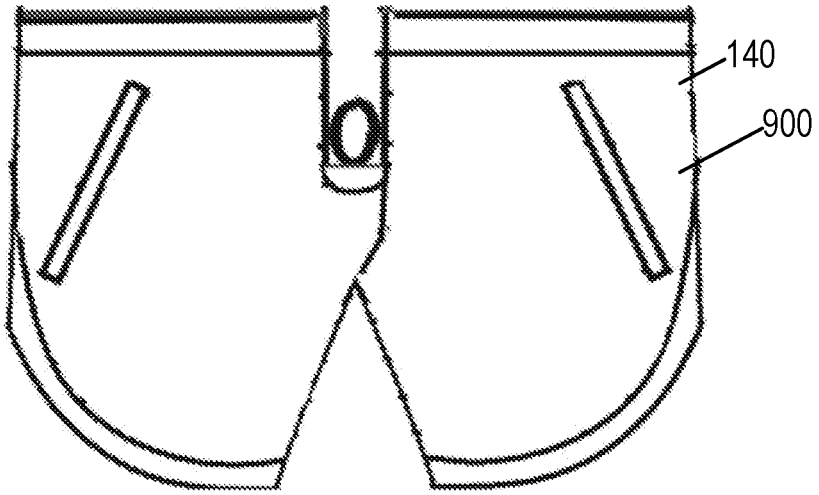
FIG. 9 shows an example of a shortened variation of the pant, according to some embodiments described herein.

FIG. 9 shows an example of the shortened variation of the pant 140, also referred to as a short 900, according to some embodiments described herein. As shown, the short 900 may be the pant 140 with the leg extensions 830 removed. In other words, the short 900 may be the pant top 820 as separated from the leg extensions 130. To convert the pant 140 into the short 900, one may release, or disengage, the respective one or more leg fasteners 840 for each leg extension 830 of the pant 140. With the leg extensions 830 separated from the remainder of the pant 140 (i.e., from the pant top 820), the pant top 820 becomes the short 900.

Although not shown, some embodiments of the jacket system 100 include both a pant 140 and a separate short 900, such that the short 900 is a separate garment from the pant 140. In that case, the pant 140 and the short 900 need not be attachable to the jacket body 110 simultaneously. Rather, in some embodiments, the pant 140 and the short 900 may be swappable such that either or neither of the pant 140 and the short 900 is attached to the jacket body 110 at a given time.

Figure 10:
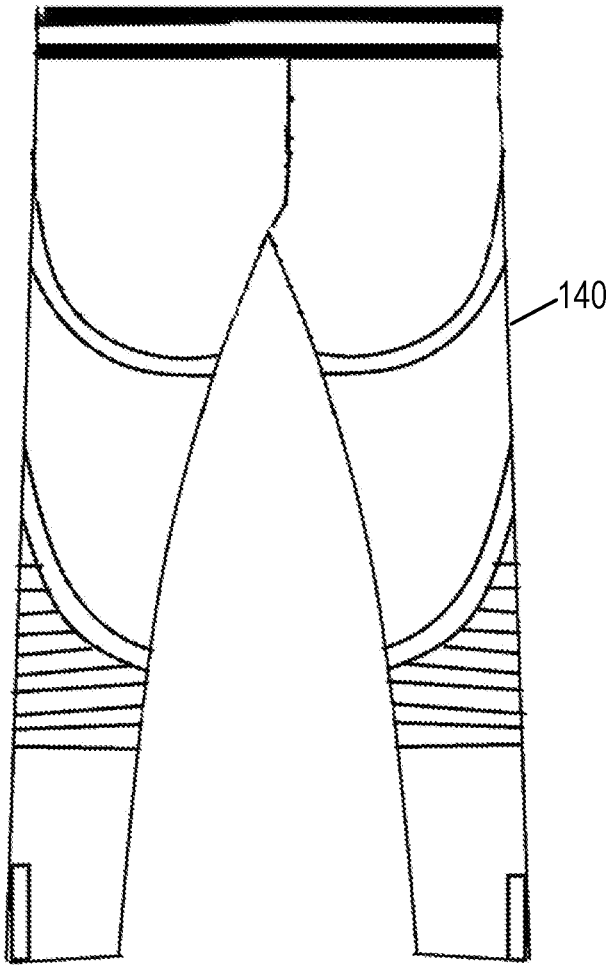
FIG. 10 shows a back view of the pant, according to some embodiments described herein.

FIG. 10 illustrates a back view of the pant 140, according to some embodiments. As shown in FIG. 10, the style of the front of the pant 140 may continue to the back of the pant 140. Specifically, for instance, a leather or leather-like material may be ribbed behind the knees as in the style of a motorcycle jacket or motorcycle pant.

FIG. 11 shows the jacket system 100 of FIG. 8 with the components configured to form a jacket 180 that includes the jacket body 110 and the pant 140, according to some embodiments described herein. In this example, the resulting jacket 180 also includes the two sleeves 120 attached to the jacket body 110. As shown in this example, when pant 140 is fastened to the jacket body 110, a jacket 180 is formed that includes that jacket body 110 and the pant 140. When such fastening is disengaged, the pant 140 then becomes detached once again. Thus, the pant 140 is removably attachable to enable the pant 140 to be attached to, and detached from, the jacket body 110 manually.

As is also shown in FIG. 8 and FIG. 11, an embodiment of the pant includes its own pant-closing fastener 850 configured to enable closing of the pant 140, such as to secure the pant 140 around a person's body. When the pant 140 is attached to the jacket body 110 and is therefore part of the jacket 180, the pant-closing fastener 850 of the pant 140 may be positioned so as to provide a continuous opening with an opening of the jacket body 110 such that, when the jacket body 110 and the pant 140 are both open, the jacket 180 as a whole is deemed open.

As described above, the jacket body 110 is configured to attach to various components by way of the waist-receiver fastener 210 of the jacket body 110. For instance, such components may include one or more of the waistband 130, the longline bottom 150, and the pant 140. Thus, one or more of the waistband 130, the longline bottom 150, and the pant 140 may be swappable, such that one may be replaced with another. As a result, in some embodiments, the jacket 180 can include no more than one of the waistband 130, the longline bottom 150, and the pant 140 at a given time.

In some embodiments, the jacket system 100 includes a hood 170, which may attach to the jacket body 110 at a collar of the jacket body 110 or by way of straps 160, as will be described below in detail. If the hood 170 attaches directly to the jacket body 110 at the collar of the jacket body 110, the jacket body 110 may include a hood-receiver fastener (shown in FIG. 11) configured to receive and removably secure the hood 170 to the jacket body 110. The hood 170 may include a hood fastener (not shown), which comprises a first fastening member and a second fastening member and complements the hood-receiver fastener and enables the hood 170 to removably attach to the jacket body 110. The hood-receiver fastener and the hood fastener may be complementary, such as two sides of a zipper or two sides of a snap fastener, thereby enabling the hood-receiver fastener and the hood fastener to engage each other to attach the hood 170 to the jacket body 110.

Figure 12:
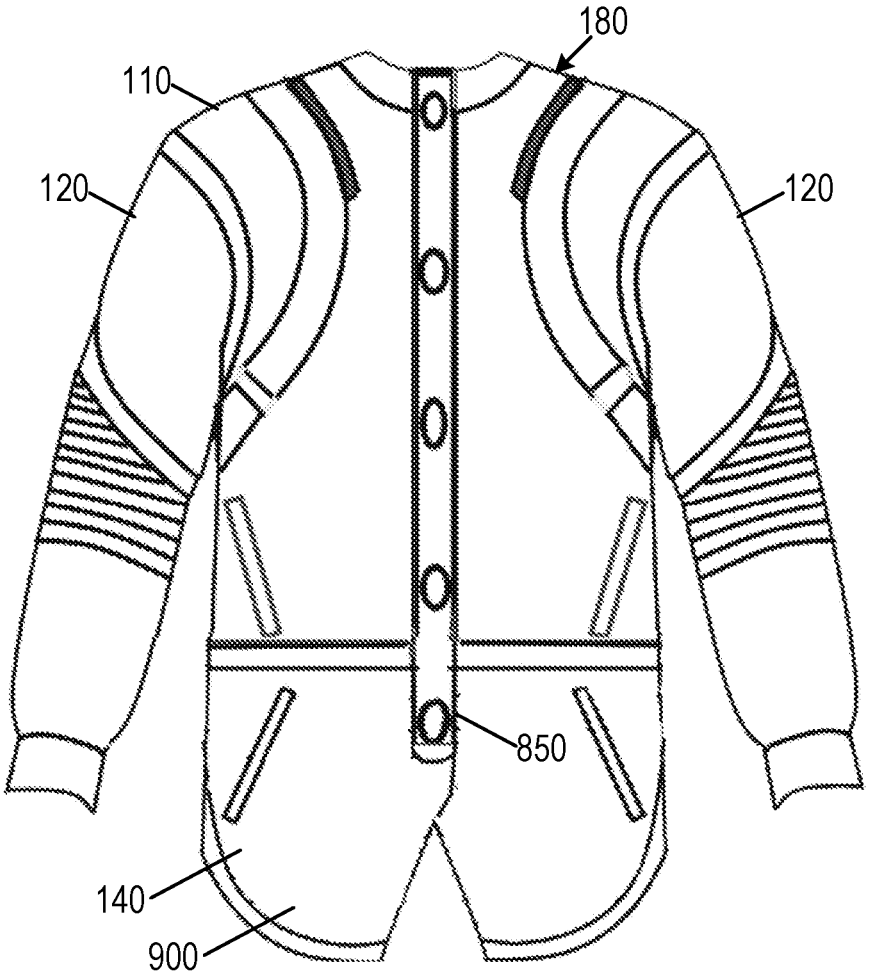
FIG. 12 shows the jacket system with the components configured to form a jacket that includes the jacket body and the shortened variation of the pant, according to some embodiments described herein.

FIG. 12 shows the jacket system 100 with the components configured to form a jacket 180 that includes the jacket body 110 and the shortened variation of the pant 140, also referred to as the short 900, according to some embodiments described herein. In this example, the resulting jacket 180 also includes the two sleeves 120 attached to the jacket body 110. As described above, the short 900 may be the pant 140 excluding the leg extensions 830. As such, this example of the jacket 180 is the same as, or similar to, the example shown in FIG. 11 but without the leg extensions 830 of the pant 140.

Figure 13:
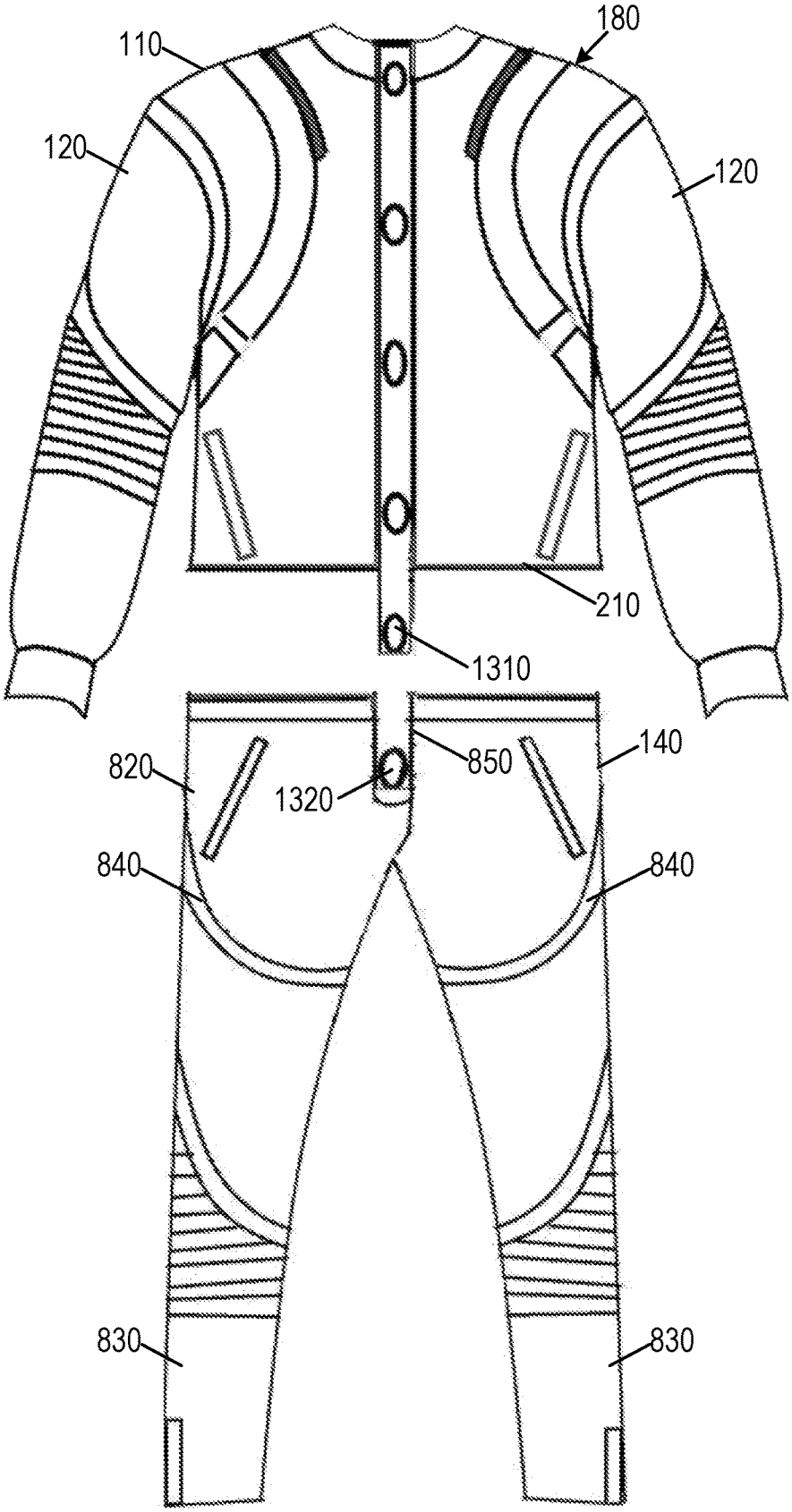
FIG. 13 shows another example of the jacket system including the jacket body and the pant, according to some embodiments described herein.

FIG. 13 shows another example of the jacket system 100 including the jacket body 110 and the pant 140, according to some embodiments described herein. Specifically, the example of FIG. 13 is a variation of the example of FIG. 8; however, in FIG. 13, the jacket body 110 includes an extended fastener 1310 to assist in securing a component of the jacket system 100 that can act as a bottom portion of the jacket 180. In some embodiments, as in the example of FIG. 13, the extended fastener 1310 of the jacket body 110 extends downward from a bottom edge (e.g., by one to four inches) of the jacket body 110. For instance, the extended fastener 1310 may overlap with a component of the jacket system 100 that is attached to the bottom of the jacket body 110, such as the waistband 130, the pant 140, or the longline bottom 150. For example, the extended fastener 1310 may be or may include a snap fastener that snaps onto a portion of such component at a lower position than the waist-receiver fastener 210 engages with such component.

In some embodiments, each of the waistband 130, the pant 140, and the longline bottom 150 may include a complementary fastener to engage the extended fastener 1310. As shown in this example, for instance, the pant 140 includes a body-securing fastener 1320 configured to engage with the extended fastener 1310 of the jacket body 110. As shown in FIG. 13, the body-securing fastener 1320 of the pant 140 is positioned lower (e.g., one to four inches lower) than a top edge of the pant 140 and lower than a bottom edge of the jacket body 110 other than the extended fastener 1310 itself.

Figure 14:
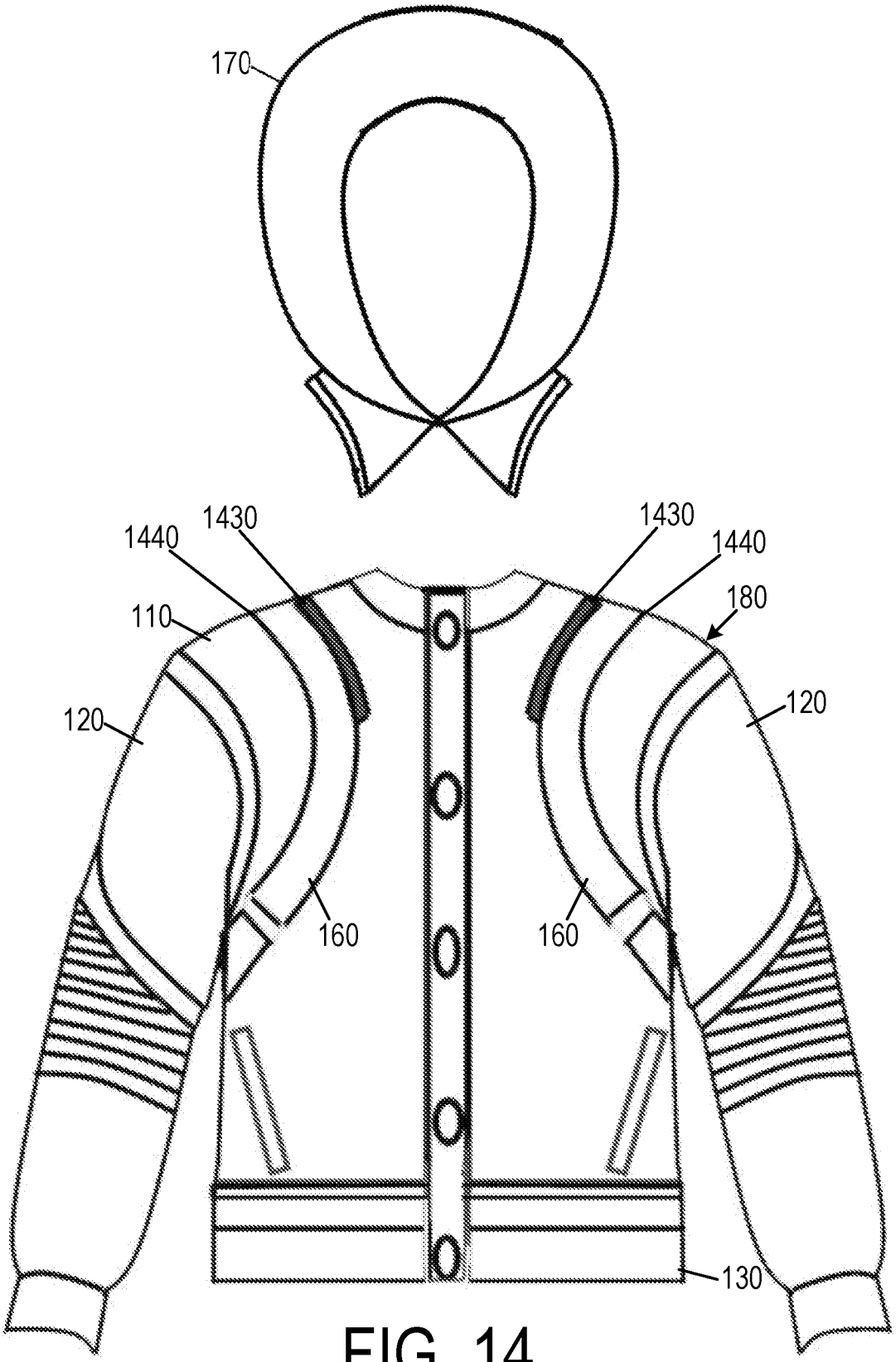
FIG. 14 shows an example of the jacket system including the jacket body, straps, and a hood, according to some embodiments described herein.

FIG. 14 illustrates an example of the hood 170 being attachable to straps 160, such as a pair of shoulder straps as shown, which are attached to the jacket body 110, according to some embodiments described herein. In the example of FIG. 14, the hood 170 is currently not attached to the jacket body 110, but the straps 160, the sleeves 120, and the waistband 130 are attached. Thus, in the example shown, the jacket 180 includes the jacket body 110, the straps 160, the sleeves 120, and the waistband 130, but not the hood 170, because the jacket 180 includes the jacket body 110 along with the attachable components that are presently attached to the jacket body 110.

In an embodiment in which the hood 170 attaches via straps 160, the straps 160 may be attachable to the jacket body 110 and, in some embodiments, also to a backpack. Some backpacks include a hood for protection from unfavorable weather conditions, for example, excessive rain, cold weather, or hot weather. A hood can cover the head of a backpack wearer to shield from such unfavorable weather conditions. A conventional hood for a backpack is part of the backpack, specifically, sewn between the straps of the backpack and designed to cover a head of someone wearing the backpack (i.e., a head between the straps and facing away from the bulk of the backpack). In some embodiments, the hood 170 of the jacket system 100 can double as both a detachable backpack hood and as a jacket hood 170. The hood 170 may be attached to straps 160 (e.g., backpack straps) that are removably attachable to the jacket 180. As such, both the straps 160 and the hood 170 are removably attachable to the jacket body 110.

In some embodiments, the hood 170 and the straps 160 are integrated into a single garment. In that case, a hood-receiver fastener 1430 of the jacket body 110 may be configured to attach such garment that includes both the straps 160 and the hood 170. Alternatively, as shown in the example of FIG. 14, the hood 170 is removably attachable to the straps 160, in which case the hood 170 can be attached to or detached from the straps 160, and the straps 160 can be attached or detached from the jacket body 110. In that case, a hood-receiver fastener 1430 or strap-receiver fastener 1440 of the jacket body 1430 is configured to engage with a strap fastener (not shown) of the straps 160 so as to attach the straps 160, and the straps 160 may further include their own respective hood-receiver fastener 1430 configured to engage with a hood fastener (not shown) of the hood 170 to attach the hood 170. In another example, although not shown of FIG. 14, the hood 170 is configured to attach directly to the jacket body 110 or to attach to the straps 160, which are configured to attach directly to the jacket body 110. In this example, the jacket body 110 includes a fastener than acts as both a hood-receiver fastener 1430 and a strap receiver fastener 1440 and is able to attach either the hood 170 or the straps 160. Thus, various configurations are within the scope of this disclosure by which the hood 170 may be attached to the jacket body 110 by way of the straps 160.

Figure 15:
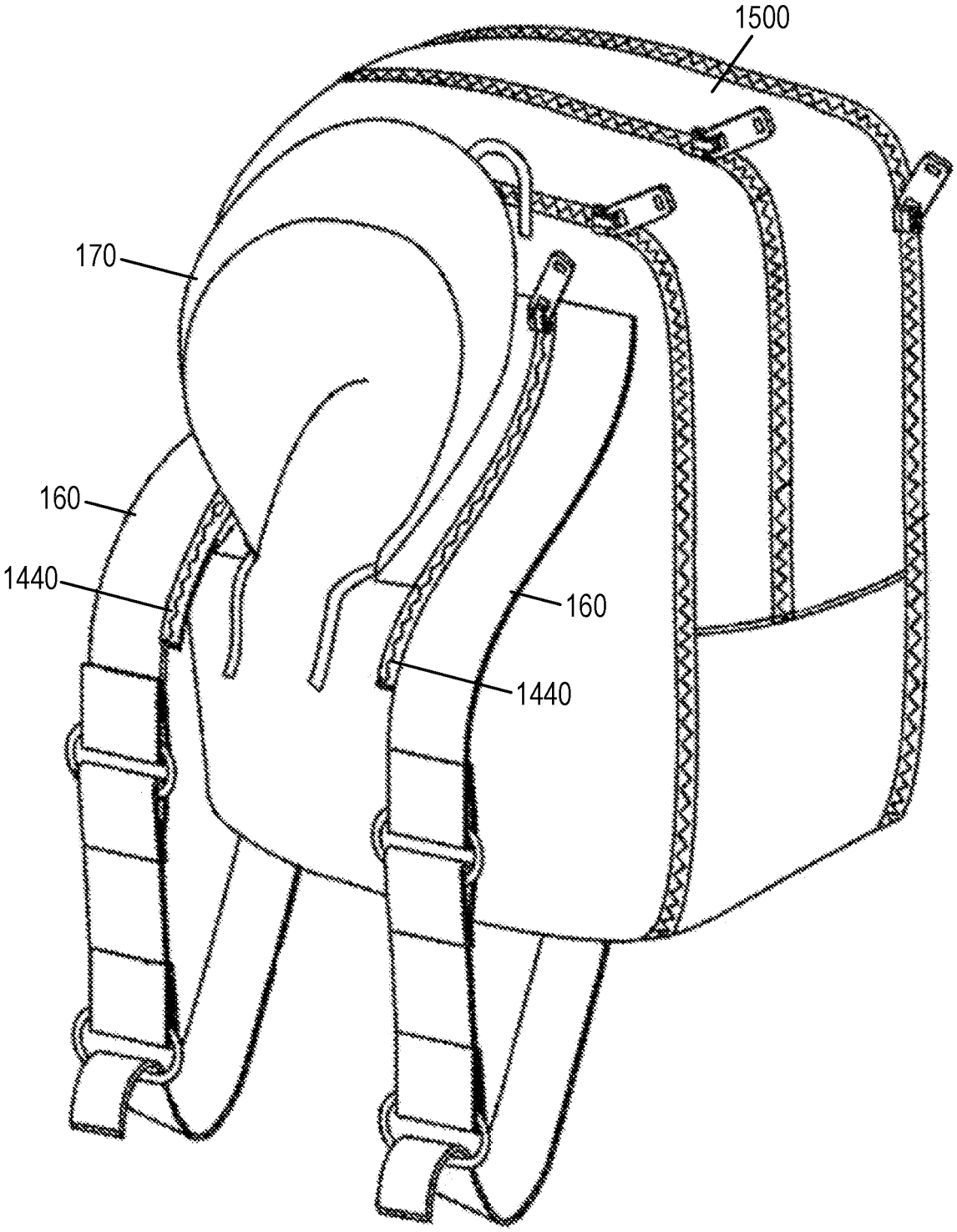
FIG. 15 shows the hood and straps of the jacket system as attached to a backpack, according to some embodiments described herein.

FIG. 15 shows the hood 170 and straps 160 of the jacket system 100 as attached to a backpack 1500, according to some embodiments described herein. In some embodiments, as in the example of FIG. 15, the hood 170 and straps 160 are configured to attach to the jacket body 110 and are configured to attach to the backpack 1500, such that the hood 170 and straps 160 are swappable between the jacket body 110 and the backpack 1500. As shown in FIG. 15, the hood 170 and straps 160 may attach to the backpack 1500 in the same manner, or a similar manner, in which the hood 170 and straps 160 are attachable to the jacket body 110. For instance, the backpack 1500 may include one or more strap-receiver fasteners 1440 configured to engage with the straps 160 and thus secure the straps 160 to the backpack 1500. When the hood 170 is attached to the straps 160, the hood 170 is thus also attached to the backpack 1500 by way of the one or more strap-receiver fasteners 1440. When attached to the jacket body 110, the hood 170 is part of the jacket 180, and similarly, when attached to the jacket body 110, the straps 160 are part of the jacket 180. When attached to the backpack 1500, the hood 170 is part of the backpack 1500, and similarly, when attached to the jacket body 110, the straps 160 are part of the backpack 1500.

Figure 16:
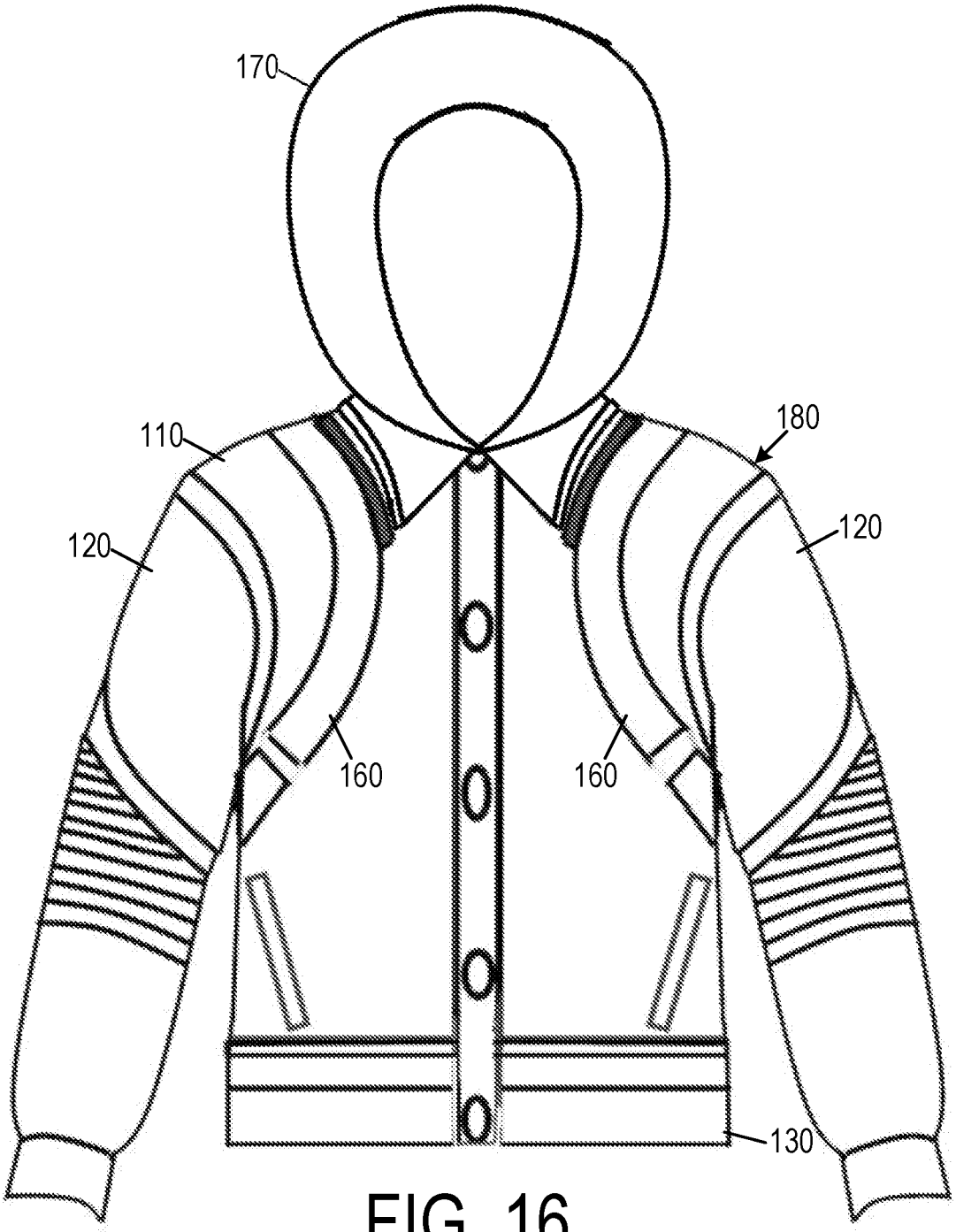
FIG. 16 shows the jacket system of FIG. 14 with the components configured to form a jacket that includes the jacket body, the straps, and the hood, according to some embodiments described herein.

FIG. 16 shows the jacket system 100 of FIG. 14 with the components configured to form a jacket 180 that includes the jacket body 110, the straps 160, and the hood 170, according to some embodiments described herein. In this example, the resulting jacket 180 also includes the two sleeves 120 and the waistband 130 attached to the jacket body 110. As shown in this example, when hood 170 is fastened to the jacket body 110, a jacket 180 is formed that includes that jacket body 110, the straps 160, the sleeves 120, and the waistband 130. When such fastening is disengaged, the hood 170 then becomes detached once again. Thus, the hood 170 is removably attachable to enable the hood 170 to be attached to, and detached from, the jacket body 110 manually.

Additionally or alternatively to the above, in some embodiments, various parts of the jacket system 100 can include detachable subcomponents. For instance, the jacket body 110 may include an inner lining and an exterior lining, removably attachable to each other by way of one or more fasteners (e.g., a zipper). In that case, the inner lining can provide warmth and protection from the elements, while the outer lining can be replaced based on aesthetics as the wearer desires. It will be understood stood that various components of the jacket system 100, such as the sleeves 120, the waistband 130, the longline bottom 150, the pant 140, or the hood 170, can have subcomponents that can be detached or swapped.

Numerous specific details are set forth herein to provide a thorough understanding of the claimed subject matter. The foregoing examples have been provided merely for the purpose of explanation and illustration and are in no way to be construed as limiting embodiments of the jacket system 100 or the jacket 180. However, those skilled in the art will understand that the claimed subject matter may be practiced without these specific details. Methods, apparatuses, or systems that would be known by one of ordinary skill have not been described in detail so as not to obscure claimed subject matter.

While the present subject matter has been described in detail with respect to specific aspects thereof, it will be appreciated that those skilled in the art, upon attaining an understanding of the foregoing, may readily produce alterations to, variations of, and equivalents to such aspects. Accordingly, it should be understood that the present disclosure has been presented for purposes of example rather than limitation and does not preclude inclusion of such modifications, variations, or additions to the present subject matter as would be readily apparent to one of ordinary skill in the art.

What is claimed is:

1. A customizable jacket comprising:

a body configured to fasten into a closed configuration and to unfasten into an open configuration, wherein, in the closed configuration, the body defines an inner space interior to the body;

a sleeve-receiver fastener integrated with the body at a shoulder of the body, the sleeve-receiver fastener configured to attach a detachable sleeve;

a detachable waistband;

a waist-receiver fastener integrated with the body along a lower portion of the body, the waist-receiver fastener configured to attach the detachable waistband; and a first shoulder strap and a second shoulder strap arranged on an exterior surface of the body and each of the first shoulder strap and the second shoulder strap extending from a respective shoulder portion of the body downwardly over a front, chest portion of the body, wherein the first shoulder strap and the second shoulder strap have a curvature that curves inward toward a center of the body;

a detachable hood comprising a first fastening member and a second fastening member;

a first hood receiver fastener positioned on the first shoulder strap on the front, chest portion of the body, wherein the first hood receiver fastener follows the curvature of the first shoulder strap;

a second hood receiver fastener positioned on the second shoulder strap on the front, chest portion of the body, wherein the second hood receiver fastener follows the curvature of the second shoulder strap; and wherein the detachable hood is configured to connect to the body by coupling the first fastening member to the first hood receiver fastener and the second fastening member to the second hood receiver fastener.

2. A jacket system comprising:

a body configured to fasten into a closed configuration and to unfasten into an open configuration, wherein, in the closed configuration, the body defines an inner space interior to the body, the body comprising:

a waist-receiver fastener integrated with the body along a lower portion of the body;

a detachable waistband;

a pant;

a longline bottom;

wherein the pant, detachable waistband, and longline bottom are toollessly attachable to the body at the waist-receiver fastener;

an extended fastener that extends past a lower edge of the body and is couplable to at least one of the detachable waistband, the pant, or the longline bottom;

a first shoulder strap and a second shoulder strap arranged on an exterior surface of the body and each of the first shoulder strap and the second shoulder strap extending from a respective shoulder portion of the body downwardly over a front, chest portion of the body, wherein the first shoulder strap and the second shoulder strap have a curvature that curves inward toward a center of the body;

a detachable hood comprising a first fastening member and a second fastening member;

a first hood receiver fastener positioned on the first shoulder strap on the front, chest portion of the body, wherein the first hood receiver fastener follows the curvature of the first shoulder strap;

a second hood receiver fastener positioned on the second shoulder strap on the front, chest portion of the body, wherein the second hood receiver fastener follows the curvature of the second shoulder strap; and wherein the detachable hood is configured to connect to the body by coupling the first fastening member to the first hood receiver fastener and the second fastening member to the second hood receiver fastener.

3. The jacket system of claim 2, further comprising:

a pair of sleeve-receiver fasteners integrated with the body; and a pair of sleeves toollessly attachable to the body at the pair of sleeve-receiver fasteners and toollessly detachable from the body.

* * * * *